US008820835B2

(12) United States Patent
Minino et al.

(10) Patent No.: US 8,820,835 B2
(45) Date of Patent: Sep. 2, 2014

(54) RESILIENT CHAIR INCORPORATING MULTIPLE FLEX ZONES

(75) Inventors: Phillip David Minino, Muscatine, IA (US); John R. Koch, Muscatine, IA (US); Marcus Curtis Koepke, Indianapolis, IN (US); Corey John Susie, West Des Moines, IA (US); Martin Calvin Koepke, Cincinnati, OH (US)

(73) Assignee: HNI Technologies Inc., Muscatine, IA (US)

( * ) Notice: Subject to any disclaimer, the term of this patent is extended or adjusted under 35 U.S.C. 154(b) by 52 days.

(21) Appl. No.: 13/597,966

(22) Filed: Aug. 29, 2012

(65) Prior Publication Data

US 2014/0062154 A1 Mar. 6, 2014

(51) Int. Cl.

| | |
|---|---|
| ***A47C 3/021*** | (2006.01) |
| ***A47C 3/025*** | (2006.01) |
| ***A47C 3/026*** | (2006.01) |
| ***A47C 1/022*** | (2006.01) |
| ***A47C 7/44*** | (2006.01) |

(52) U.S. Cl.
CPC .. *A47C 1/022* (2013.01); *A47C 7/44* (2013.01)
USPC ..... 297/296; 297/285

(58) Field of Classification Search
CPC ..... A47C 3/045; A47C 7/445
USPC ..... 297/285, 296
See application file for complete search history.

(56) References Cited

U.S. PATENT DOCUMENTS

| | | | |
|---|---|---|---|
| 809,944 | A | 1/1906 | Hanger |
| 2,807,310 | A | 9/1957 | Sellner |
| 2,921,622 | A | 1/1960 | Henrickson et al. |
| 3,111,344 | A | 11/1963 | Hoven et al. |
| 3,393,941 | A | 7/1968 | Grossfillex |
| 3,934,932 | A | 1/1976 | Ekornes |
| 4,046,422 | A | 9/1977 | Ambasz |
| 4,084,850 | A | 4/1978 | Ambasz |
| 4,157,203 | A | 6/1979 | Ambasz |

(Continued)

FOREIGN PATENT DOCUMENTS

| | | | |
|---|---|---|---|
| EP | 0196819 | A2 | 10/1986 |
| EP | 0309368 | A1 | 3/1989 |

(Continued)

OTHER PUBLICATIONS

International Search Report and Written Opinion issued in PCT/US2013/056918, mailed Dec. 2, 2013, 18 pages.

(Continued)

*Primary Examiner* — Rodney B White
(74) *Attorney, Agent, or Firm* — Faegre Baker Daniels LLP

(57) ABSTRACT

A reclining chair has a base coupled to a chair back. The chair back is adapted to recline from an upright position to a reclined position. To accommodate that reclining motion, the chair back includes a flex zone formed with notches extending through an inner portion of the flex zone. Those notches narrow as the chair back reclines from the upright position to the reclined position. The flex zone also includes an outer portion that is separated from the inner portion by a gap, the outer portion having one or more notches extending through the outer portion. Those notches also narrow as the chair back reclines from the upright position to the reclined position.

20 Claims, 17 Drawing Sheets

(56) References Cited

U.S. PATENT DOCUMENTS

| | | | |
|---|---|---|---|
| 4,379,589 | A | 4/1983 | Marino |
| 4,585,272 | A | 4/1986 | Ballarini |
| D289,120 | S | 4/1987 | Chadwick et al. |
| 4,709,962 | A | 12/1987 | Steinmann |
| 4,733,910 | A | 3/1988 | Brennan |
| D296,394 | S | 6/1988 | Chadwick et al. |
| D299,192 | S | 1/1989 | Chadwick et al. |
| 4,856,846 | A | 8/1989 | Lohmeyer |
| 4,880,273 | A | 11/1989 | Markus |
| 4,913,493 | A | 4/1990 | Heidmann |
| 4,979,778 | A | 12/1990 | Shields |
| 4,981,326 | A | 1/1991 | Heidmann |
| 4,984,846 | A | 1/1991 | Ekornes |
| 5,076,646 | A | 12/1991 | Matte |
| 5,102,196 | A | 4/1992 | Kaneda et al. |
| 5,244,252 | A | 9/1993 | Serber |
| 5,251,958 | A | 10/1993 | Roericht et al. |
| 5,303,978 | A | 4/1994 | Murrey |
| 5,314,237 | A | 5/1994 | Koepke et al. |
| 5,338,094 | A | 8/1994 | Perry |
| 5,340,197 | A | 8/1994 | Vogtherr |
| 5,383,712 | A | 1/1995 | Perry |
| 5,486,035 | A | 1/1996 | Koepke et al. |
| 5,522,182 | A | 6/1996 | Rogers |
| 5,558,399 | A | 9/1996 | Serber |
| 5,597,203 | A | 1/1997 | Hubbard |
| 5,599,069 | A | 2/1997 | Lorbiecki |
| 5,611,598 | A | 3/1997 | Knoblock |
| 5,660,439 | A | 8/1997 | Unwalla |
| 5,725,277 | A | 3/1998 | Knoblock |
| 5,735,574 | A | 4/1998 | Serber |
| 5,782,536 | A | 7/1998 | Heidmann et al. |
| 5,785,384 | A | 7/1998 | Sagstuen |
| 5,806,930 | A | 9/1998 | Knoblock |
| 5,810,438 | A | 9/1998 | Newhouse |
| 5,909,923 | A | 6/1999 | DeKraker |
| 5,957,534 | A | 9/1999 | Wilkerson et al. |
| 5,979,984 | A | 11/1999 | DeKraker et al. |
| 6,056,361 | A | 5/2000 | Cvek |
| 6,070,937 | A | 6/2000 | Ginat |
| 6,109,696 | A | 8/2000 | Newhouse et al. |
| 6,257,665 | B1 | 7/2001 | Nagamitsu et al. |
| 6,435,615 | B1 | 8/2002 | Zapf |
| 6,533,352 | B1 | 3/2003 | Glass et al. |
| 6,554,360 | B1 | 4/2003 | Wilke et al. |
| 6,641,214 | B2 | 11/2003 | Veneruso |
| 6,722,735 | B2 | 4/2004 | Lucci et al. |
| 6,739,663 | B2 | 5/2004 | Gevaert |
| 6,739,665 | B1 | 5/2004 | Leib et al. |
| 6,779,846 | B2 | 8/2004 | Spendlove et al. |
| 6,786,548 | B2 | 9/2004 | Heidmann et al. |
| 6,923,503 | B2 | 8/2005 | Sangiorgio |
| 6,935,690 | B2 | 8/2005 | Lucci et al. |
| 6,986,549 | B2 | 1/2006 | Kniese |
| 7,004,543 | B2 | 2/2006 | Caruso et al. |
| 7,073,860 | B2 | 7/2006 | Markus |
| 7,073,864 | B2 | 7/2006 | Olsen |
| 7,114,777 | B2 | 10/2006 | Knoblock et al. |
| 7,114,782 | B2 | 10/2006 | Ambasz |
| 7,118,177 | B2 | 10/2006 | Piretti |
| 7,234,774 | B2 | 6/2007 | Heidmann et al. |
| 7,334,842 | B1 | 2/2008 | Wu et al. |
| 7,360,835 | B2 | 4/2008 | Tubergen et al. |
| 7,472,962 | B2 | 1/2009 | Caruso et al. |
| D587,915 | S | 3/2009 | Igarashi |
| D599,125 | S | 9/2009 | Piretti |
| 7,611,202 | B2 | 11/2009 | Johnson et al. |
| 7,621,600 | B2 | 11/2009 | Buchbinder |
| 7,686,395 | B2 | 3/2010 | Piretti |
| 7,695,067 | B2 | 4/2010 | Goetz et al. |
| D618,004 | S | 6/2010 | DeSanta et al. |
| D661,504 | S | 6/2012 | Saotome |
| 8,567,864 | B2 * | 10/2013 | Deisig et al. ..... 297/285 X |
| 2005/0161990 | A1 | 7/2005 | Piretti |
| 2007/0063563 | A1 | 3/2007 | Maze et al. |
| 2008/0272636 | A1 | 11/2008 | Machael et al. |
| 2009/0102268 | A1 | 4/2009 | Schmitz et al. |
| 2009/0195040 | A1 | 8/2009 | Birkbeck |
| 2009/0261644 | A1 | 10/2009 | Piretti |
| 2012/0228911 | A1 * | 9/2012 | Piretti ..... 297/285 |
| 2012/0274111 | A1 | 11/2012 | Piretti |

FOREIGN PATENT DOCUMENTS

| | | | |
|---|---|---|---|
| EP | 2110051 | A1 | 10/2009 |
| JP | 07155232 | A | 6/1995 |
| WO | WO2009039231 | A2 | 3/2009 |

OTHER PUBLICATIONS

Partial International Search Report issued in PCT/US2013/056918, mailed Oct. 10, 2013, 5 pages—(document named: PartialSR_056918).

* cited by examiner

RESILIENT CHAIR INCORPORATING MULTIPLE FLEX ZONES

BACKGROUND

Existing chairs with reclining backs often employ complex mechanisms to accommodate reclining motion, and such complex mechanisms are often expensive to manufacture. These complex mechanisms include, for example, separate linkages for the front links of a four bar mechanism, separate components that rotate with respect to one another about set pivot points, and/or springs used to resist reclining forces. In addition, chairs using traditional pivot points limit how the chair may move to a prescribed motion.

SUMMARY

A chair system includes a flexible back support member that couples a chair back to a base. The flexible back support member includes a flex zone formed from a flexible material. The flex zone has a first portion defining a first notch that is adapted to narrow as the chair back reclines from an upright position to a reclined position. The flex zone also includes a second portion defining a second notch that is adapted to narrow as the chair back reclines from the upright position to the reclined position. The first portion of the flex zone and the second portion of the flex zone are laterally separated by a gap.

While multiple embodiments are disclosed, still other embodiments of the present invention will become apparent to those skilled in the art from the following detailed description, which shows and describes illustrative embodiments of the invention. Accordingly, the drawings and detailed description are to be regarded as illustrative in nature and not restrictive.

Figure 1:
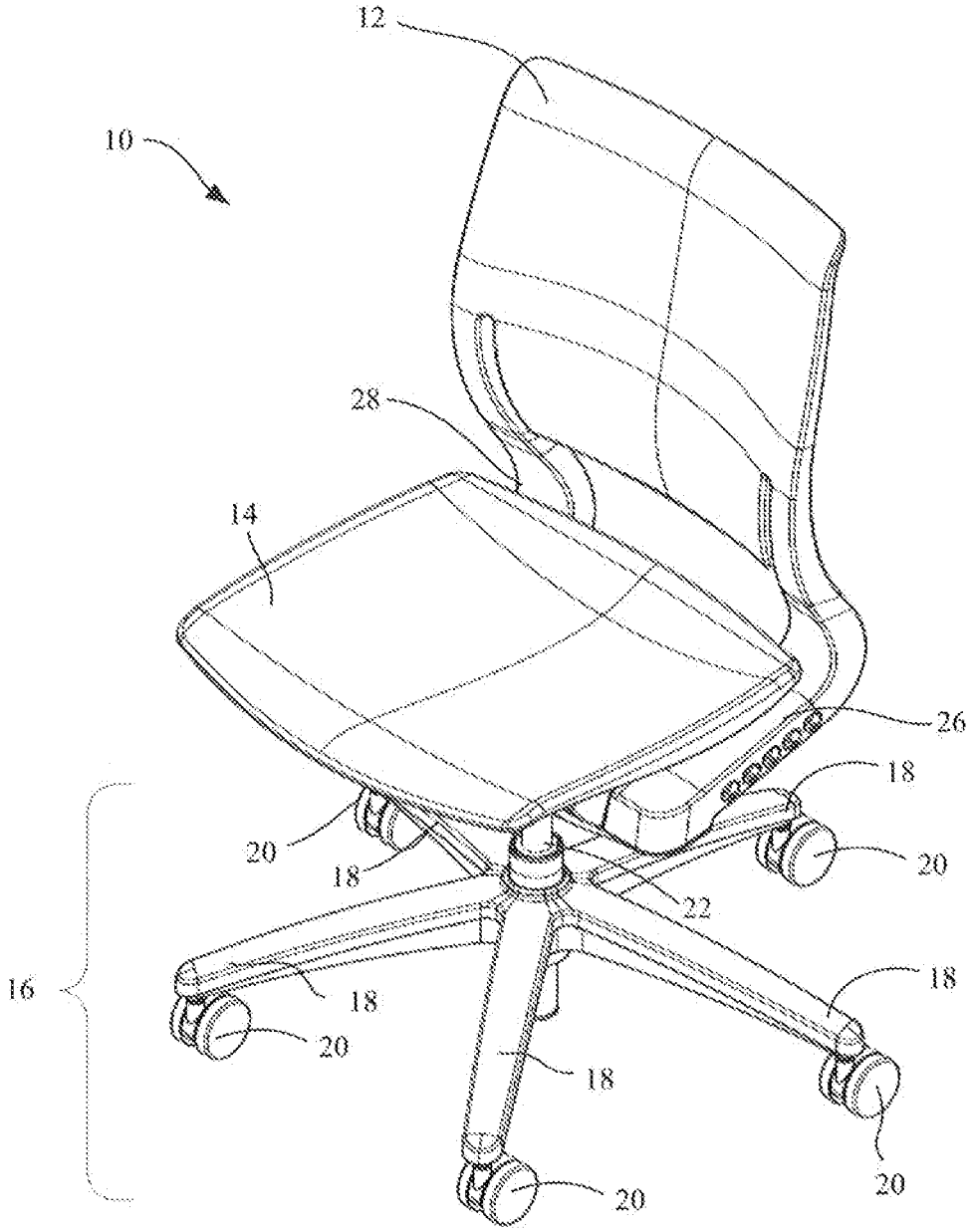
FIG. 1 illustrates a front perspective view of a chair system, according to some embodiments.
Figure 2:
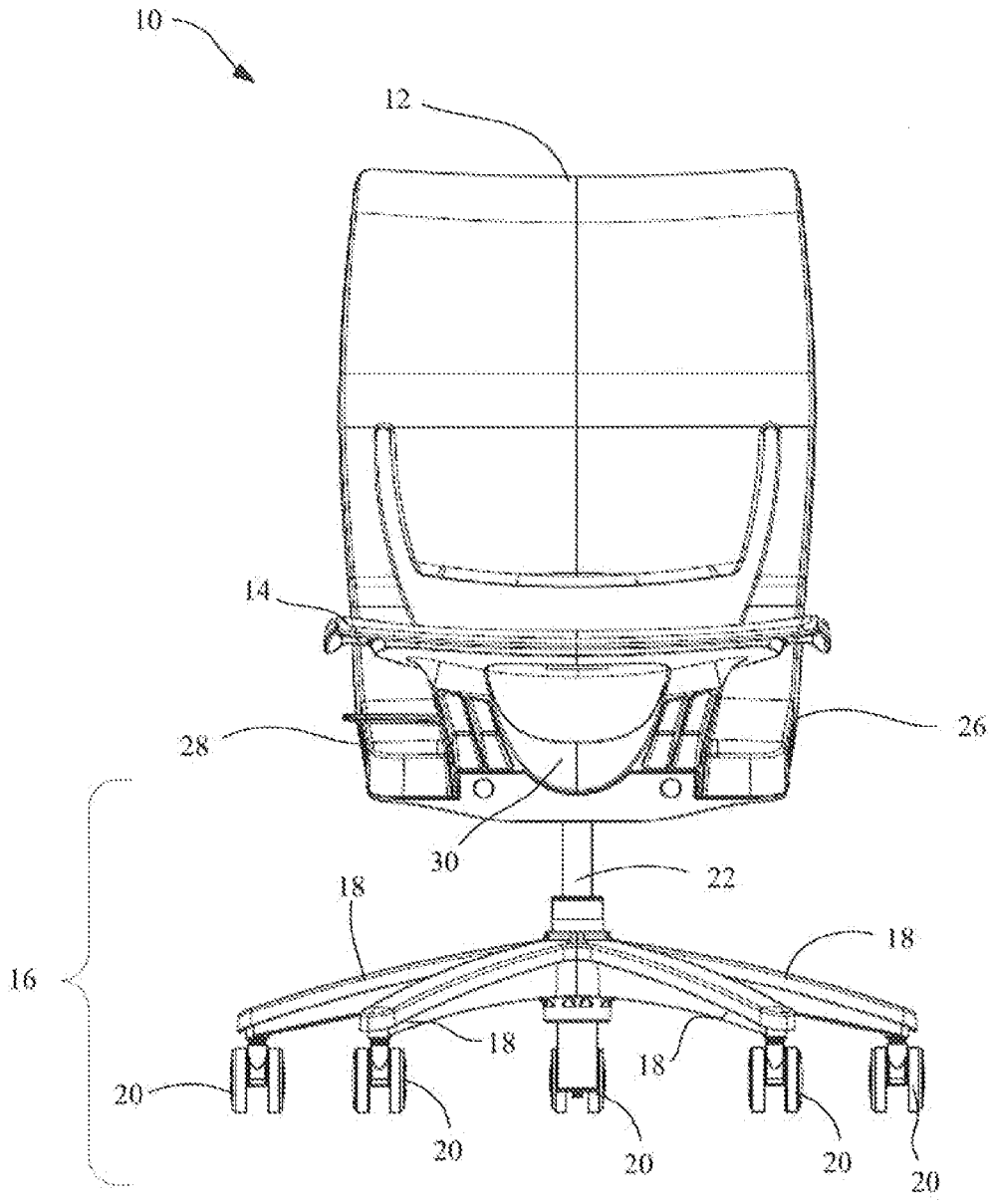
FIG. 2 illustrates a front view of the chair system of FIG. 1, according to some embodiments.
Figure 3:
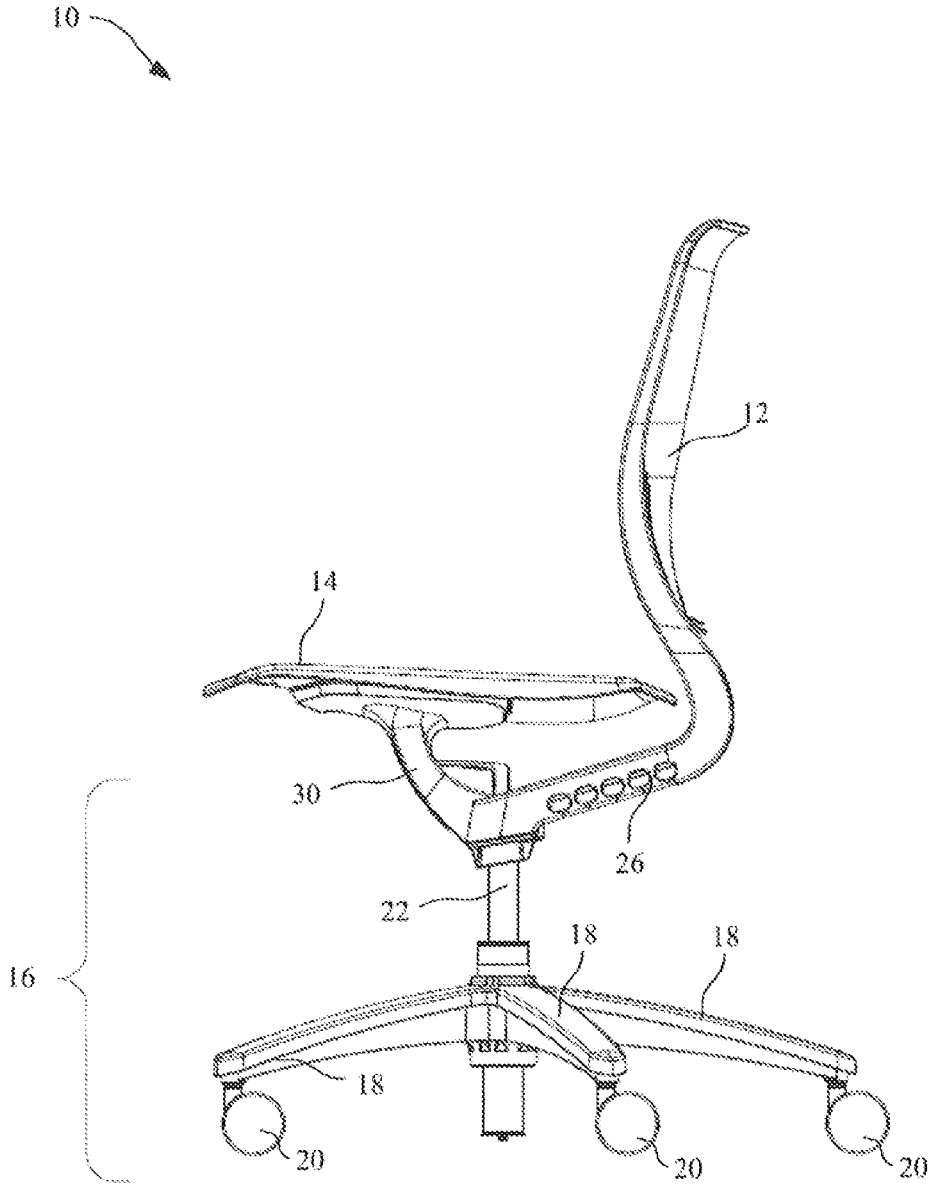
FIG. 3 illustrates a side view of the chair system of FIG. 1, according to some embodiments.
Figure 4:
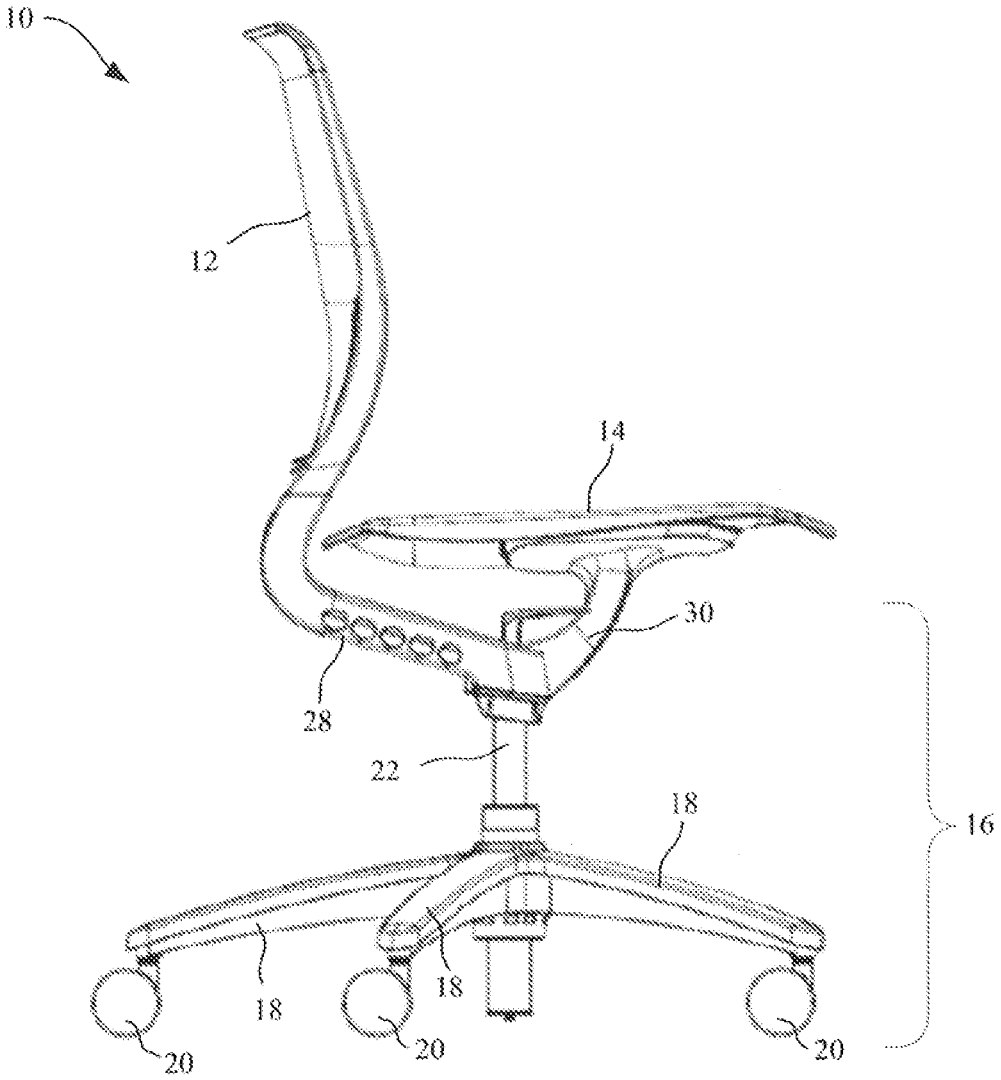
FIG. 4 illustrates an opposite side view of the chair system of FIG. 1, according to some embodiments.
Figure 5:
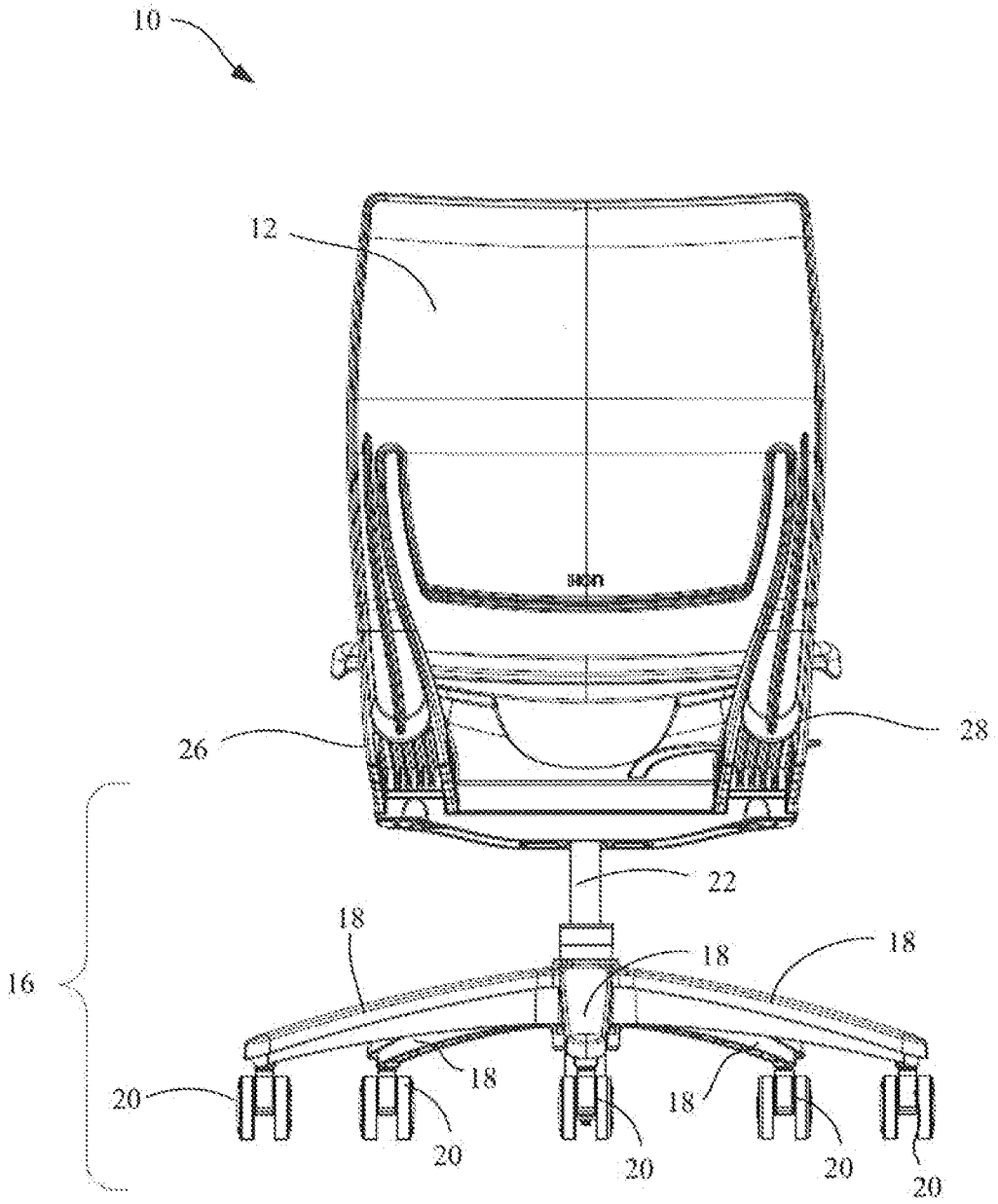
FIG. 5 illustrates a rear view of the chair system of FIG. 1, according to some embodiments.
Figure 6:
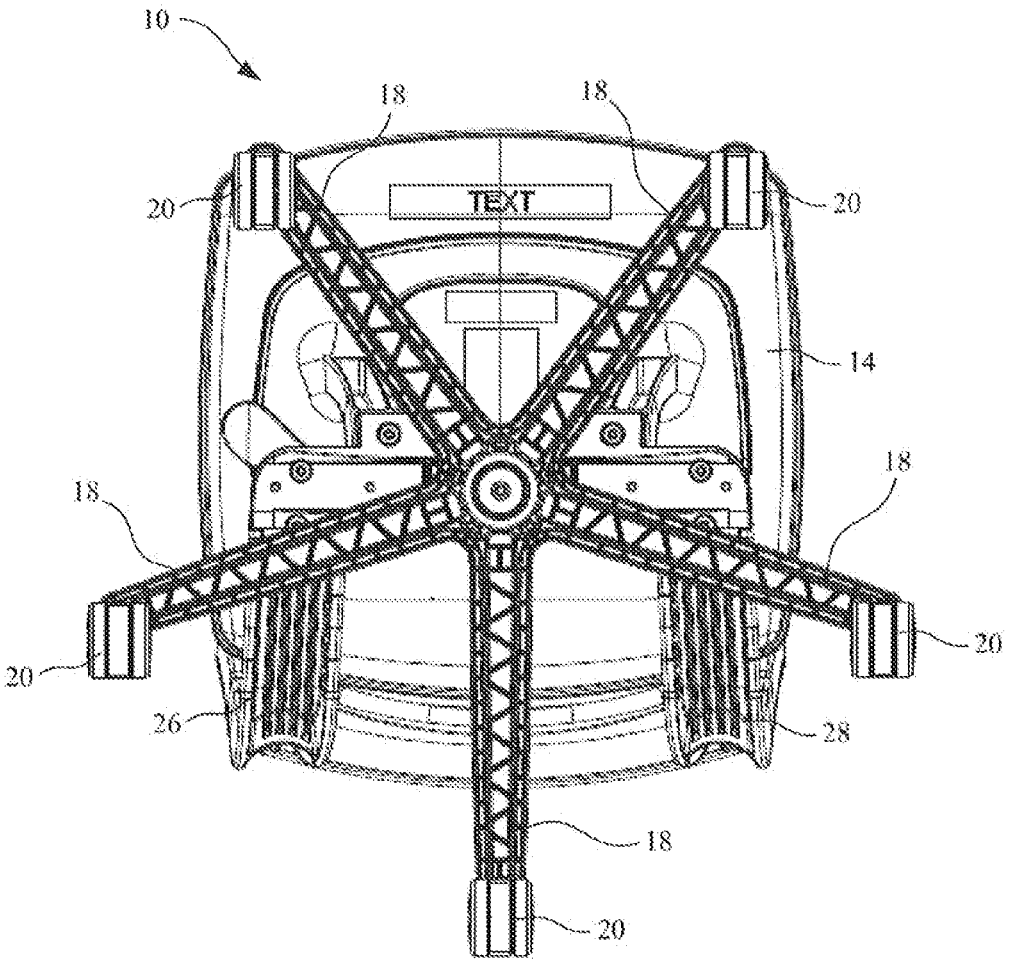
FIG. 6 illustrates a bottom view of the chair system of FIG. 1, according to some embodiments.
Figure 7:
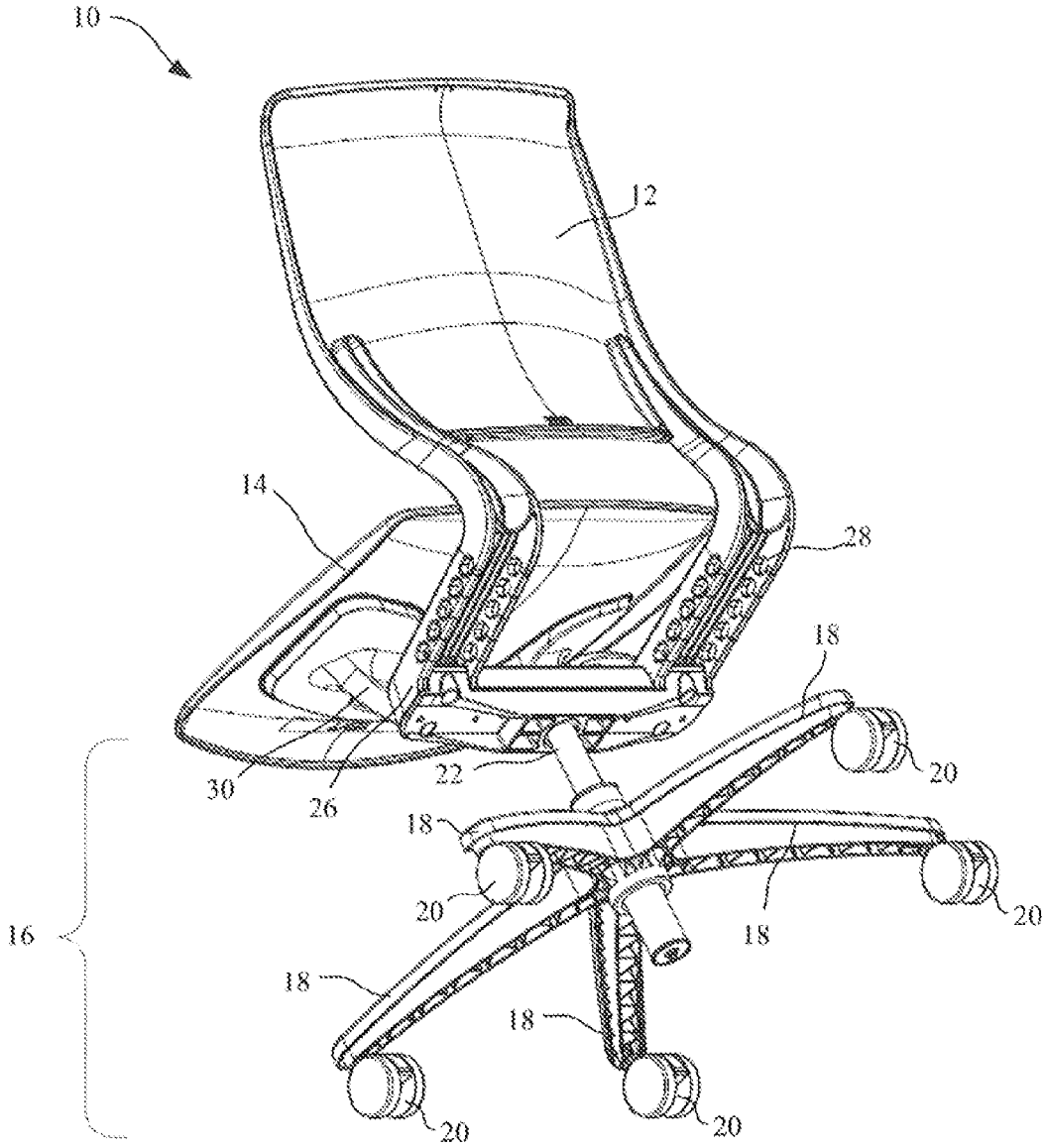
FIG. 7 illustrates a rear perspective view of the chair system of FIG. 1, according to some embodiments.
Figure 8:
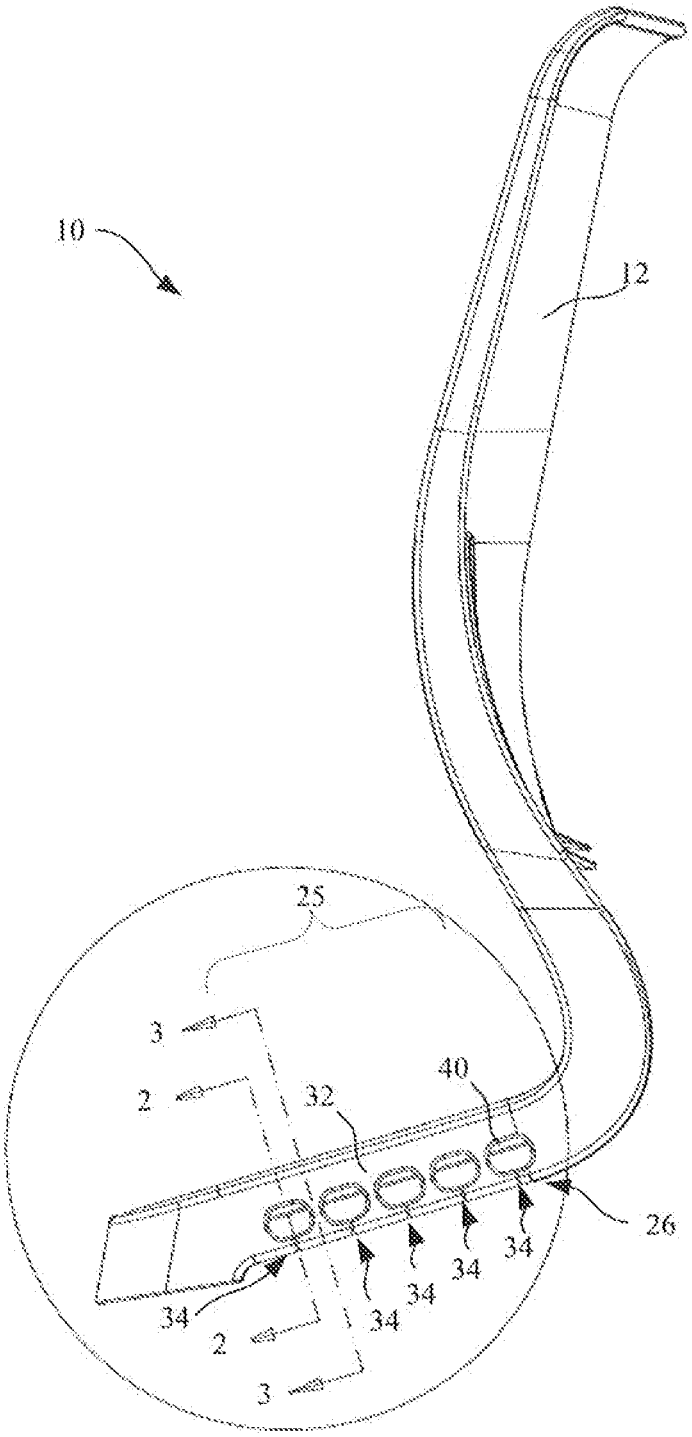
FIG. 8 illustrates a side view of a chair back with a flexible support member of the chair system of FIG. 1, according to some embodiments.

While the invention is amenable to various modifications and alternative forms, specific embodiments have been shown by way of example in the drawings and are described in detail below. The intention, however, is not to limit the invention to the particular embodiments described. On the contrary, the invention is intended to cover all modifications, equivalents, and alternatives falling within the scope of the invention as defined by the appended claims.

DETAILED DESCRIPTION

As shown in FIGS. 1-7, a chair system 10 includes a chair back 12, a seat 14 for a user, and a base 16. In some embodiments, the base 16 includes support legs 18 that include rollers or casters 20 and a cylinder 22. As shown, the legs 18 are coupled to each other and are coupled to the seat 14 by the cylinder 22. Although a base 16 with five legs 18 is shown in FIG. 1, a variety of other bases may be used, such as a pedestal base with a central support and side legs, or a pedestal base without support legs, for example.

As shown in FIGS. 1-7, the chair back 12 includes a flexible back support member 26 (sometimes referred to herein as a flexible support member) that is coupled to the chair back 12 (or, in some embodiments, integrally formed with the chair back 12) and to the base 16 (e.g., to the cylinder 22). As used herein, the term "coupled" is used in its broadest sense to refer to elements which are connected, attached, and/or engaged, either directly or integrally or indirectly via other elements, and either permanently, temporarily, or removably.

In some embodiments, the flexible back support member 26 is unitarily formed with the chair back 12 from a single piece of material through injection molding or through a similar process, although separate, connected components are also contemplated. The chair back 12 shown in FIGS. 1-7 also includes a second flexible back support member 28, which is a mirror of the flexible back support member 26 and is located on the other side of the chair system 10 to couple the chair back 12 to the base 16. In some embodiments, the flexible back support members 26, 28 are located so as to be below and/or behind a user in the chair system.

According to some embodiments, each flexible back support member 26, 28 derives its ability to flex and to resist recline from the particular configuration of each flexible back support member 26, 28 as well each from the materials (e.g., the modulus of elasticity of the materials) that form each flexible back support member 26, 28, as discussed below in more detail. As also shown in FIGS. 1-7, the chair system includes a seat support 30 (as shown in, e.g., FIG. 2) coupled to the seat 14 and to the base 16.

FIGS. 8-13 illustrate embodiments in which a chair back 12 has an outer flex zone 25. The outer flex zone 25 includes a flexible support member 26 with an outer portion 32 into which notches 34 are formed. The flexible support member 26 also has an inner flex zone 35 that includes an inner portion 36 into which notches 38 are formed. In some embodiments, the outer flex zone 25 and the inner flex zone 35 are parallel and of the same length.

The outer portion 32 and the inner portion 36 are laterally separated by a gap 40. In some embodiments, the flexible support member 26 includes a plurality of ridges 42 integrally formed with an upper portion 44 to which the inner portion 36 and the outer portion 32 are also integrally formed. The plurality of ridges 42 longitudinally extend along some or all of the flex zones 25, 35. As used herein, the term "longitudinally" is used to refer to the direction indicated generally by arrow 53 of FIG. 11, and to a direction which travels along a longest dimension or length of an element, including curved elements. As used herein, the term "laterally" is used to refer to a direction orthogonal to the longitudinal direction indicated generally by arrow 53 of FIG. 11.

In some embodiments, the inner portion 36, the outer portion 32, the upper portion 44 and the ridges 42 are integrally or unitarily formed (e.g., molded or injection molded) of a single material. Exemplary materials include plastics, nylons (e.g., PA6 nylon), polypropylene, and/or other polymers, according to embodiments of the present invention. The materials may be selected in order to provide flexible support members with high flexibility, low modulus of elasticity, and high strength, according to some embodiments. In some embodiments, for example, the flexible back support member 26 is formed of a material having a substantially homogeneous and isotropic modulus of elasticity.

In some embodiments, the flex zones 25, 35 are designed to flex at more than one point to create greater mobility. For example, the flexible support member 26 creates flex zones 25, 35 that may flex near or at any single notch (or plurality of notches), depending on the nature and direction of the reclining force, such that the lower surface of that notch (or notches) contacts its opposing surface (or their opposing surfaces) while the remaining notches remain open (e.g., the lower surfaces of those notches do not contact their opposing surfaces). In some embodiments, the flex zones 25, 35 are located below a seat to create a relative pivot point near the user's hip joint so that the chair back 12 tracks with the user's back during recline.

As the user initially reclines the chair back from an upright position, all of the notches (e.g., notches 34) remain open and the primary force resisting the reclining movement originates from the material used to form the flexible support members as well as the configuration of the flexible support members. For example, the material forming the upper portion 40 and the ridges 44 (as well as the material forming the outer portion 32 and the inner portion 36, e.g., near the notches 34, 38) flex to accommodate the reclining motion of the chair back while contributing the primary resistance, or in some embodiments, essentially all of the resistance, to that motion.

In some embodiments, the notches (e.g., notches 34) are configured to narrow as the back 12 reclines from an upright position (57 in FIG. 16) to a reclined position (57' in FIG. 16), and as the flexible back support member (e.g., flexible back support member 26) undergoes bending, according to some embodiments. For example, at least a portion (e.g., the whole portion and/or a bottom end) of the side surface 46 of each notch 34 moves closer to at least a portion (e.g., the whole portion and/or a bottom end) of the opposing adjacent side surface 50 of the notch 34 during reclining. As the chair back 12 continues to recline, those two surfaces make contact, for example, at or toward their bottom ends, to create a "recline stop," or a position of step increased reclining resistance. The term "recline stop," as used herein, refers to the additional resistance contributed by the flexible support member 26 when the surfaces 46, 50 of a notch make contact, which in some embodiments fully oppose the reclining forces and in other embodiments only partially oppose the reclining forces. In some embodiments, all of notches 34 are open when the chair back 12 is in the upright position, whereas at least one of the notches 34 is closed when the chair back 12 is in the reclined position, which includes configurations in which at least a portion of that notch 34 is closed.

In some embodiments, the upper portion 40 and/or a section (e.g., section 37 in FIGS. 9A, 9B) of the outer portion 32 above the location of each notch 34, and/or sections (e.g., section 39 in FIGS. 9A, 9B) of the inner portion 36 above the location of each notch 38 represents the lowest area moments of inertia along the flexible back support member 26 and along the flex zones 25, 35. As used herein, an area moment of inertia refers to a cross-sectional characteristic associated with an ability to bend in which a higher area moment of inertia indicates a higher resistance to bending. As a result, the flexible back support member 26 will bend more along the flex zones 25, 35 at a location near the notches 34, 38 than in other locations along the flex zones 25, 35. Thus, the area moment of inertia of the flexible support member 26 between notches 34, 38 is larger than the area moment of inertia of the flexible support member 26 at the location of the notches 34, 38, according to some embodiments.

When each notch 34, 38 closes or partially closes, the effective area moment of inertia for the flexible support member 26 at the location of the closed notch 34, 38 increases. This creates additional opposing forces that, in some embodiments, stops the reclining motion. In other embodiments, the closing or partial closing of each notch 34, 38 increases the forces opposing the reclining motion without stopping the reclining motion. In those embodiments, the user experiences a reclining resistance which increases in a manner similar to a step function as each of the notches 34, 38 closes. If the notches 34, 38 are too wide for a flexible back support member 26 of a given modulus of elasticity and cross-sectional shape, the flexible back support member 26 will recline too far and/or deform in an undesirable way. If the notches 34, 38 are too narrow, the flexible back support member 26 will not recline far enough. The notches 34, 38 may each have a substantially uniform width with respect to other notches 34, 38 in the upright position (57 in FIG. 16), according to embodiments of the present invention.

Figure 9A:
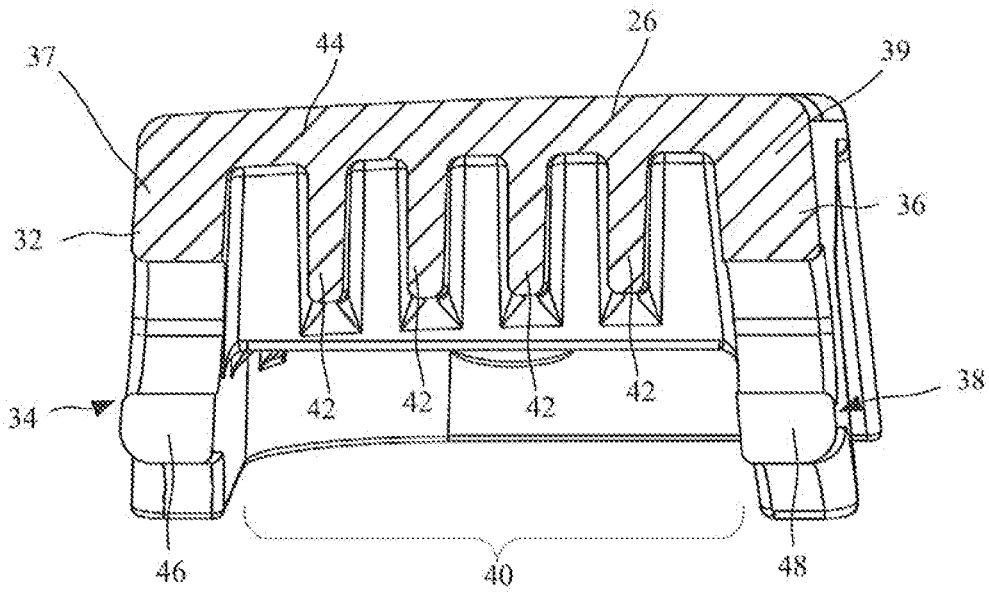
FIG. 9A illustrates a cross-sectional view of the a flexible support member of FIG. 8 with the chair back in an upright position, cut along the line 2-2 in FIG. 8, according to some embodiments.
Figure 9B:
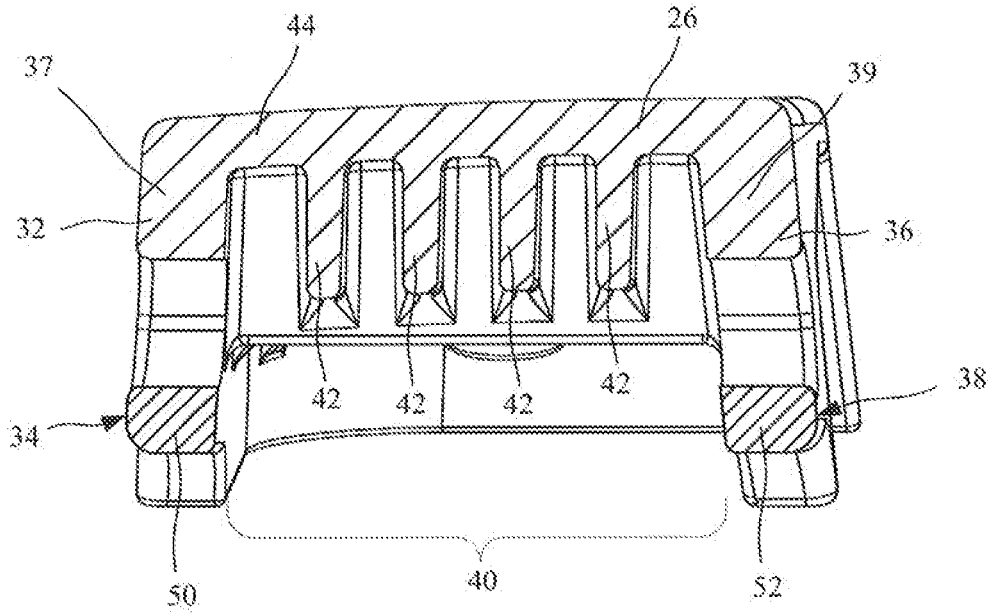
FIG. 9B illustrates a cross-sectional view of the a flexible support member of FIG. 8 with the chair back in a reclined position, cut along the line 2-2 in FIG. 8, according to some embodiments.
Figure 10:
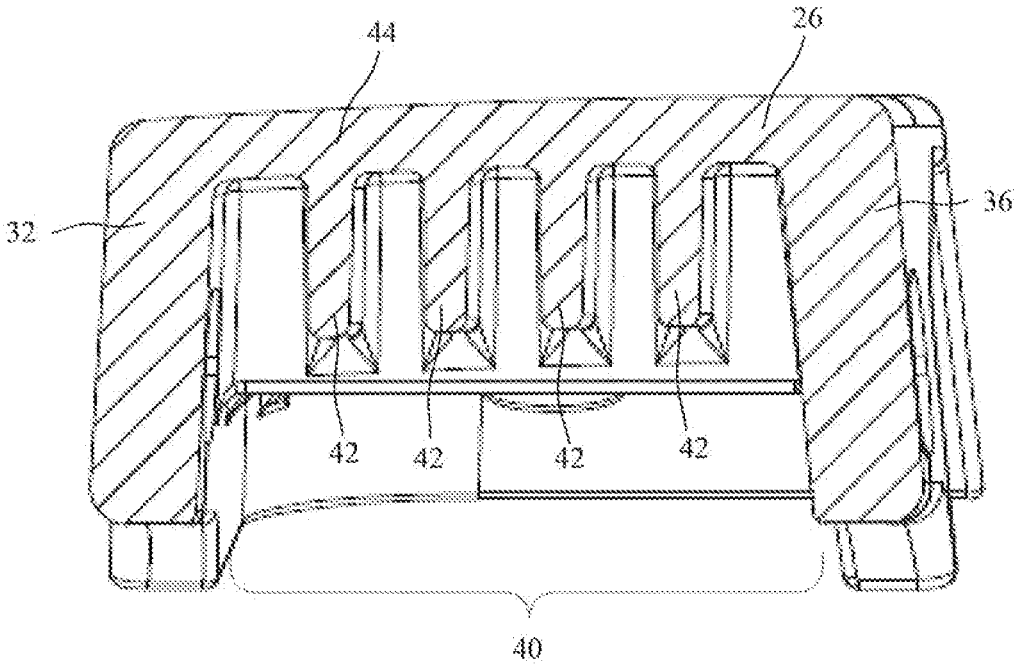
FIG. 10 illustrates a cross-sectional view of the flexible support member of FIG. 8 cut along the line 3-3 in FIG. 8, according to some embodiments.
Figure 11:
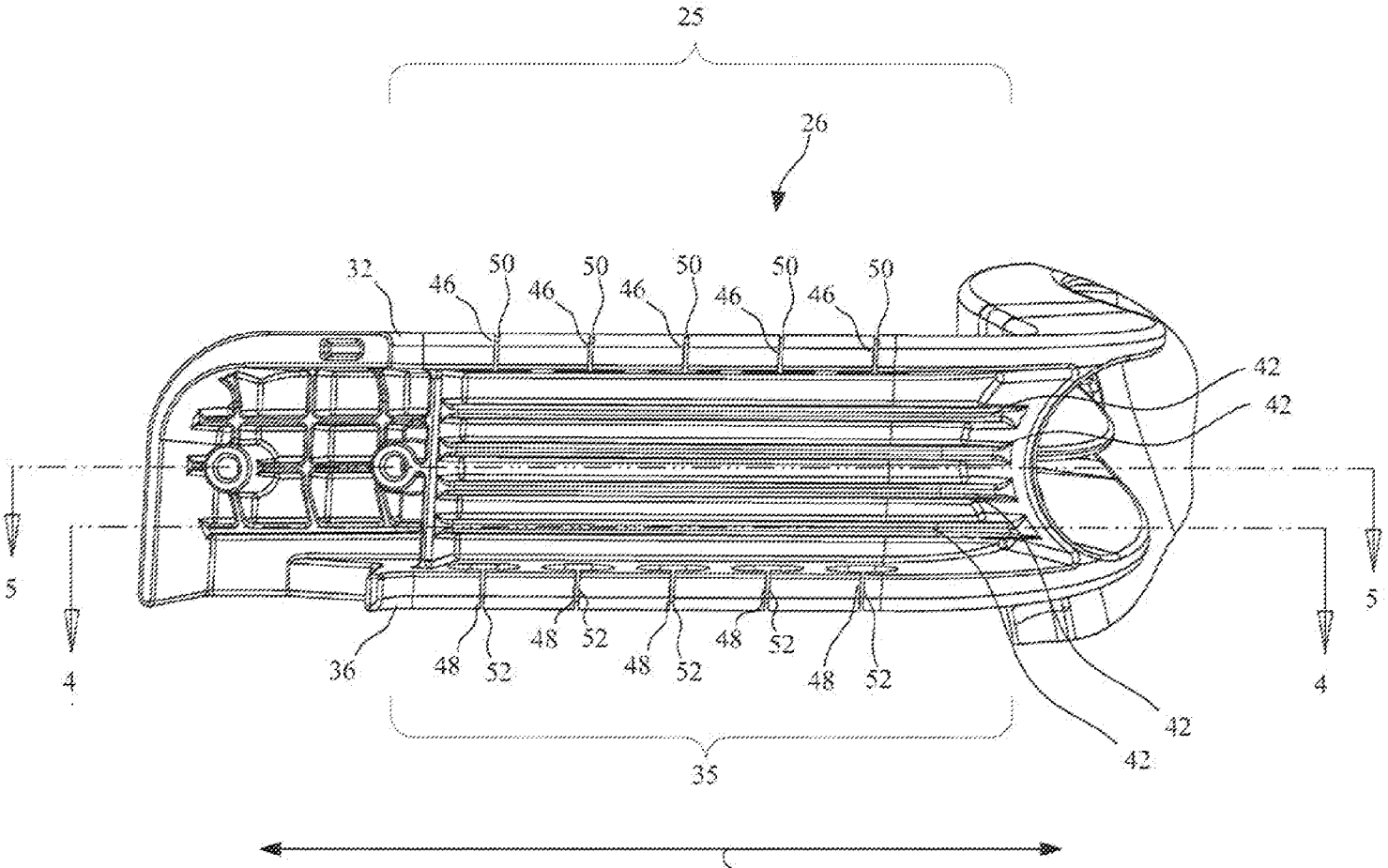
FIG. 11 illustrates a bottom view of a flexible support member of the chair system of FIG. 1, according to some embodiments.
Figure 12:
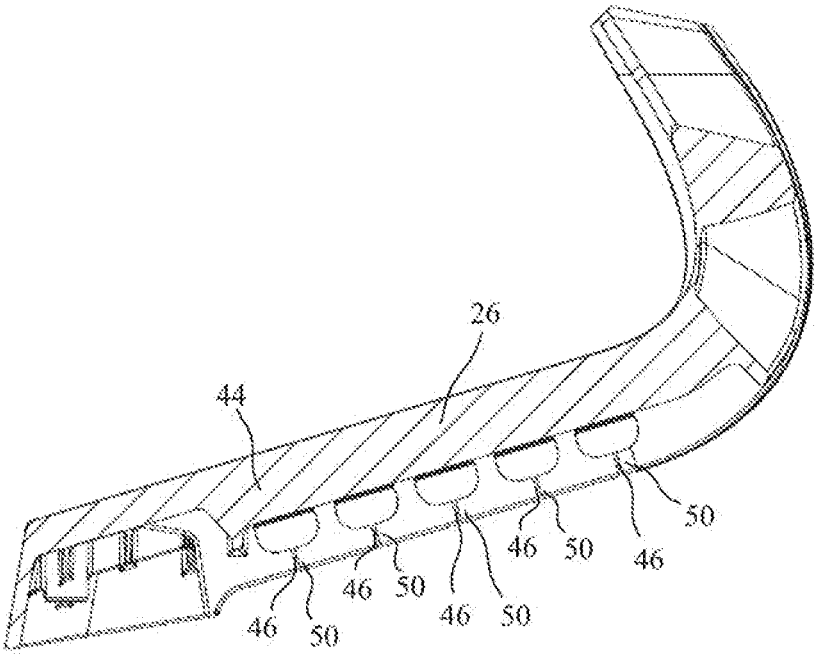
FIG. 12 illustrates a cross-sectional view of the flexible support member of FIG. 11 cut along the line 4-4 in FIG. 11, according to some embodiments.
Figure 13:
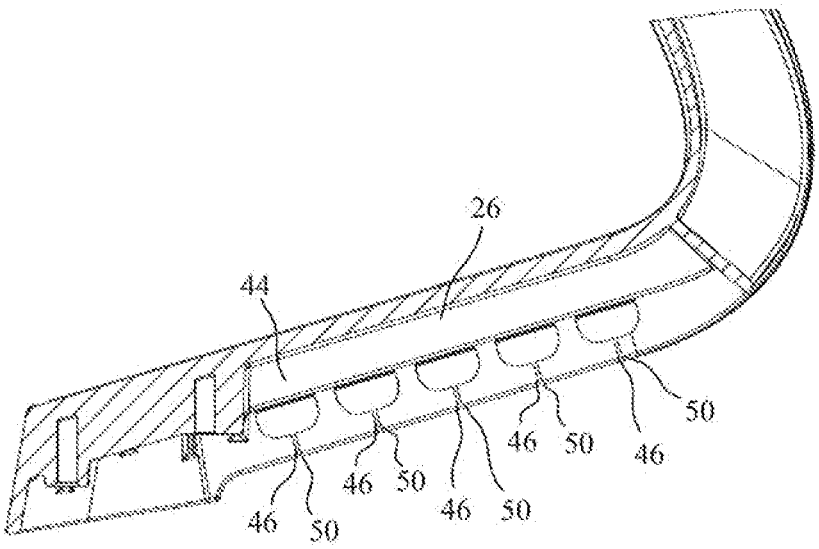
FIG. 13 illustrates a cross-sectional view of the flexible support member of FIG. 11 cut along the line 5-5 in FIG. 11, according to some embodiments.

FIG. 9A illustrates a cross-sectional view of the flexible support member 26 in an unflexed configuration. Specifically, each of the notches 34, 38 defines surfaces (e.g., lower surfaces 46, 48) that do not contact an opposing surface (e.g., lower surfaces 50, 52) in that unflexed configuration. For that reason, the lower surfaces 46, 48 are not illustrated with cross-sectional hatching in FIG. 9A. FIG. 9B illustrates that same cross-sectional view of the flexible support member 26 in a flexed position, in which the lower surfaces 46, 48 at least partially contact opposing lower surfaces 50, 52. For that reason, the lower surfaces 46, 48 are illustrated with cross-sectional hatching in FIG. 9B. Thus, the one or more notches are configured to narrow as the back reclines from the upright position to the reclined position, and wherein the one or more notches are open in the upright position and closed in the reclined position.

Figure 14:
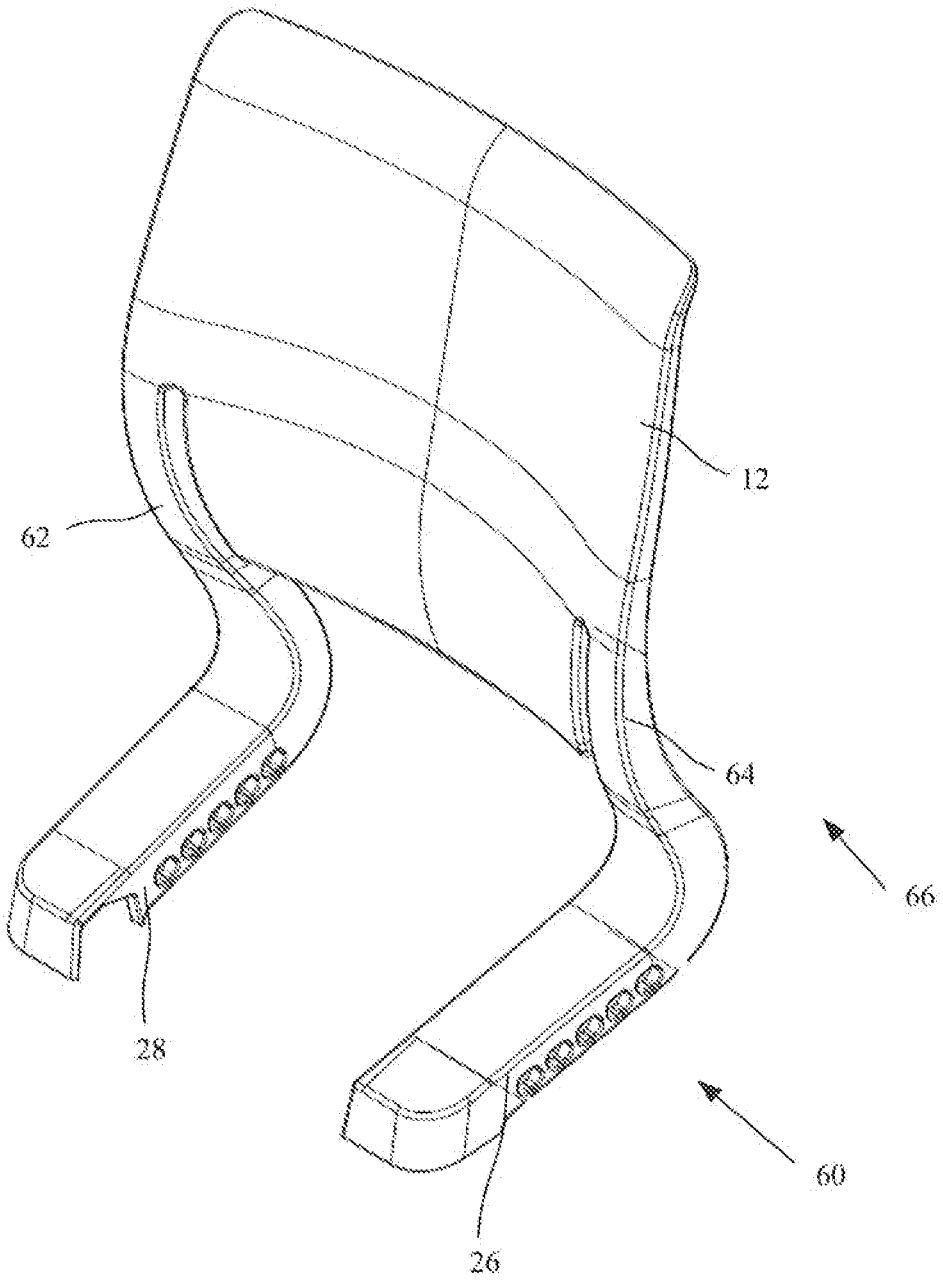
FIG. 14 illustrates a front perspective view of a chair back of the chair system of FIG. 1, according to some embodiments.

FIG. 14 illustrates embodiments in which a chair back 12 includes the flexible back support members 26, 28 integrally formed therewith. In other embodiments, the flexible back support members 26, 28 may be separately formed from the chair back 12 and then coupled to the chair back 12. The flexible back support members 26, 28 form, either singularly or collectively, a lower flex region 60. The chair back 12 may also include additional flex zones 62, 64, as part of an upper flex region 66 that may be located near a user's lumbar area. In some embodiments, the chair back 12 and the flex zones 62, 64, and/or flex region 66 may each be molded as a single unit, and/or may each be molded of the same material.

Figure 15:
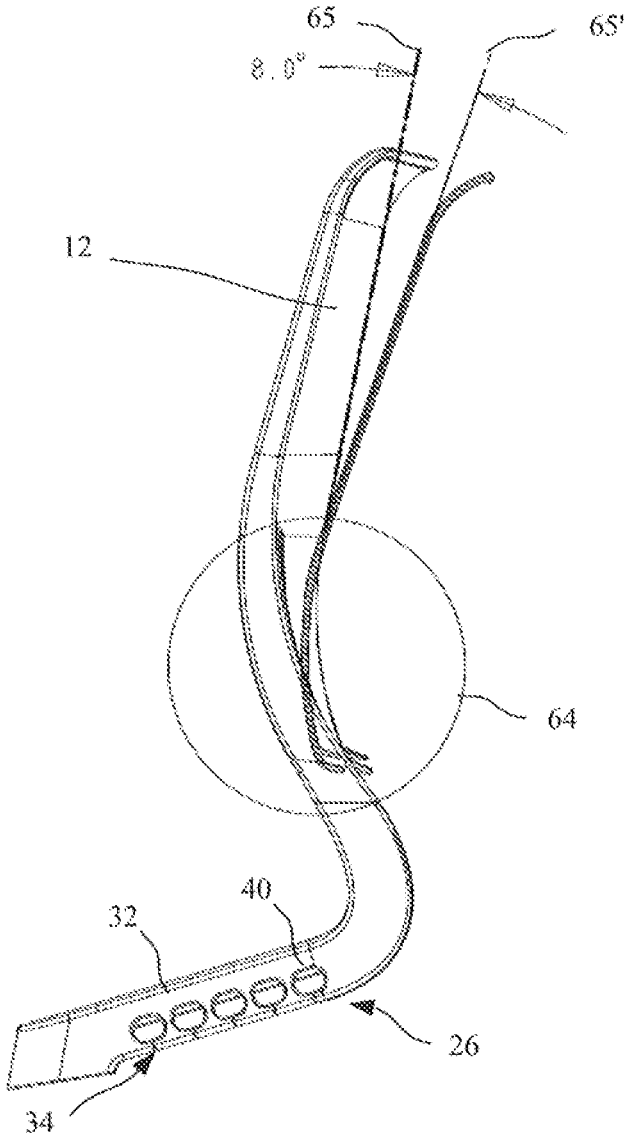
FIG. 15 illustrates a side view of the chair back of FIG. 14, according to some embodiments.

FIG. 15 illustrates a side view of the chair back 12 in both the upright position 65 and a reclined position 65'. In some embodiments, the entire chair back 12 flexes during the reclining motion and the flex zone 64 (or upper flex region 66) includes those portions of the chair back 12 that flex most during the reclining motion. In other embodiments, portions of the chair back 12 do not flex during the reclining motion and the chair back 12 includes a specific flex zone 64 (or upper flex region 66) designed to flex in response to reclining forces. In the embodiment shown in FIG. 15, the chair back reclines about 8 degrees before the resistive forces equal the reclining forces. In some embodiments, a variety of angular values are contemplated, including from about 2 degrees to about 12 degrees, during typical use—although the chair back may recline to a greater degree in response to atypical forces on the chair back (e.g., flexing forces on the chair back that exceed those normally exerted by user during ordinary use of the chair).

Figure 16:
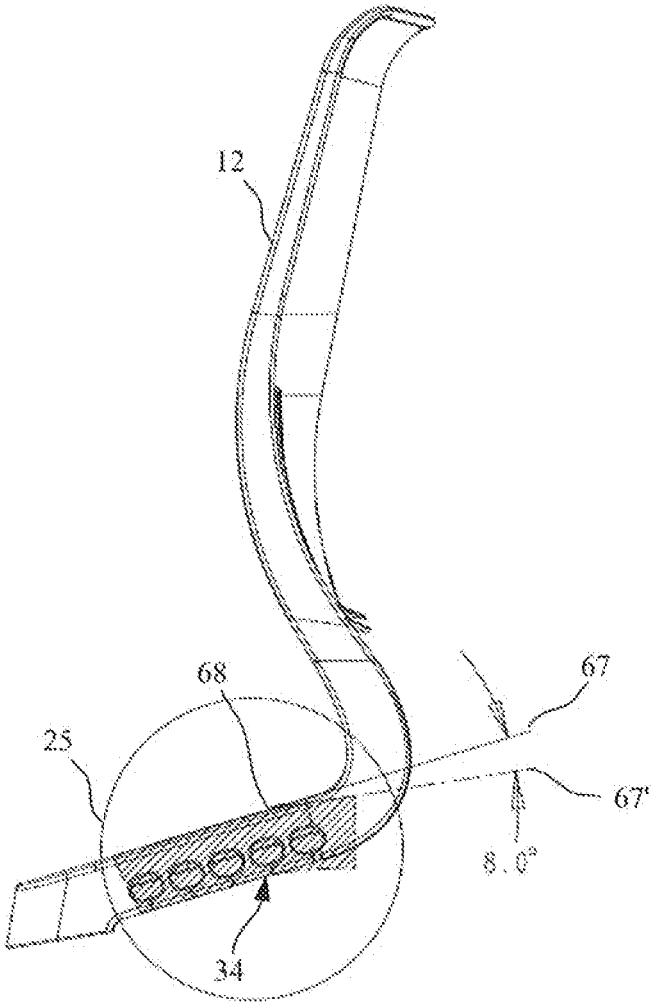
FIG. 16 illustrates a second side view of the chair back of FIG. 14, according to some embodiments.

FIG. 16 illustrates a side view of a chair back 12 in which the flex zone 25 has moved from an unflexed position 67 into a flexed position 67'. As discussed above, the effective pivot location could range anywhere along the flex zone 25. In some embodiments, the chair back 12 uses one or more flex zones to recline without using traditional pivot points or traditional springs. In the embodiment shown in FIG. 16, the chair back reclines about 8 degrees before the resistive forces equal the reclining forces (including, e.g., additional forces provided when the notch 34 at least partially closes). In some embodiments, a variety of angular values are contemplated, including from about 2 degrees to about 12 degrees, during typical use—although the chair back may recline to a greater degree in response to atypical forces on the chair back (e.g., flexing forces on the chair back that exceed those normally exerted by user during ordinary use of the chair).

Figure 17:
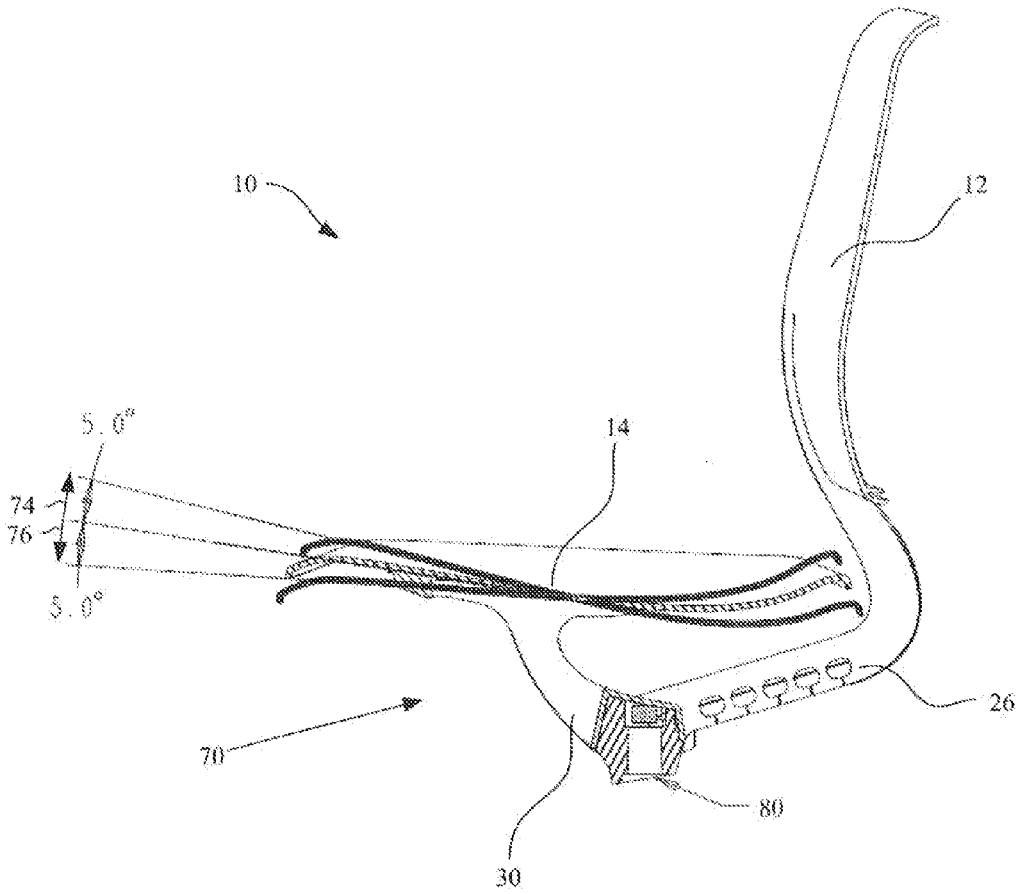
FIG. 17 illustrates a side view of the chair system of FIG. 1 showing a cylinder connection area of the seat support, according to some embodiments.

FIG. 17 illustrates an embodiment in which a seat support 30 connects a seat 14 to a base (not shown). Specifically, the seat support includes a seat flex region 70. The seat flex region 70 includes one or more flex zones. For example, the seat flex region 70 could have a flex zone on the left side and a flex zone on the right side. Alternatively, or in addition, the seat flex region 70 could have a flex zone in the center of the seat flex region 70. In some embodiments, the seat flex region 70 is formed of one or more resilient materials, which may be the same materials from which the seat back and/or flex zones of the seat back are formed. In some embodiments, the seat may tilt independent of any reclining by the chair back 12 (using the flexible back support member 26) and vice versa.

The seat flex region 70 allows the seat 14 to tilt in a clockwise direction 74 or in a counter clockwise direction 76 (as shown in FIG. 17). In the embodiment shown in FIG. 17, the seat 14 tilts up to about 5 degrees in either direction before the resistive forces equal the reclining forces. In some embodiments, a variety of angular values are contemplated, including from about 2 degrees to about 10 degrees, during typical use—although the seat may tilt to a greater degree in response to atypical forces on the seat (e.g., flexing forces on the seat that exceed those normally exerted by user during ordinary use of the chair). In some embodiments, the seat flexing region 70 provides greater resistance to tilting motions by the seat 14 in one direction (e.g., the clockwise direction 74 as shown in FIG. 17) than in the other direction (e.g., the counter-clockwise direction 76 as shown in FIG. 17). In the embodiments shown in FIG. 17, the seat flex region is coupled to the seat 14 without employing a separate linkage.

In some embodiments, a chair system 10 is formed from three main components: a chair back 12 that includes two flexible back support members (including, e.g., flexible back support member 26) either integrally formed with the chair back or coupled to the chair back, a seat portion 14 that includes a seat flex region 70, either integrally formed with the seat or coupled thereto, and a base (not shown in FIG. 17). The seat portion 14 may include a cylinder connection area 80 sized to receive and couple to a cylinder from the base. The chair back 12 may couple to the seat portion 14 or may couple to the cylinder of the base.

According to some embodiments of the present invention, the flexible back support member may be formed of any resilient material, may have many different shapes, and/or may be used without any springs or traditional resistance mechanisms, depending on requirements of the system. A flexible back support member could also be integrated in many different locations on the chair to cause the back to recline, possibly with a different relative pivot point to the seat.

According to some embodiments, the chair system includes various flex zones that effectively decreases the number of parts that have to be assembled, which generally increases ease of assembly and disassembly, product longevity, and product recyclability. In addition, use of the flex zones allows for a more independent motion from one side of the chair system to the other and allows for more visual design freedom and use of lower cost materials and processes (e.g., plastic instead of steel or aluminum castings and mechanical/steel springs). It also provides for a compact and integrated design.

Embodiments of the present invention also provide a more unique solution that does not have to be adjusted for various sized users and that accommodates different postures of any given user. For example, the chair system (e.g., the flexible back support members and/or seat flex region) provides a range of potential flex points that are positioned to react to the location and to the magnitude of a user's center of gravity. For example, reclining motions by a larger user will simply cause the flex zones to bend at a different point than reclining motions by a smaller user. In addition, the chair system will flex differently when the user sits forward on the seat (in which the seat flex region will flex to a greater degree than the flexible back support members) than when the user slouches in the chair (in which the flexible back support members will flex to a greater degree than the seat flex region) or when the user sit in a more upright position (in which the seat flex region and the flexible back support members move more in concert). Furthermore, use of different flexible back support members on either side of the chair back (and/or multiple flex zones in the seat flex region) creates a chair system that flexes in response to a shift in the user's center of gravity from side to side. Thus, in various embodiments the chair system will move with the user through wide range of motions and postures.

The notches in the flexible back support member may also be created by cutting slits in the plastic, by insert molding, by removing a part to form the notches, by assembling a secondary piece to create small notches that could not otherwise be molded, and/or over-molding a soft material that compresses in the notches to have a more constant or linear increase in recline force rather than a "hard stop" (i.e., when the resistance increases in a manner similar to a step function). According to other embodiments of the present invention, the size, shape, and/or composition of the ridges may vary to change the spring rate or increase the moment of inertia of the system. Notch number and size can vary (e.g., one notch or a plurality of notches that close) depending on how tall the flex zones are and on how much back recline is desired. In some embodiments, the flexible back support member creates the reclining motion (e.g., provides effective pivot points) in addition to supplying resistance to the reclining motion.

Various modifications and additions can be made to the exemplary embodiments discussed without departing from the scope of the present invention. For example, while the embodiments described above refer to particular features, the scope of this invention also includes embodiments having different combinations of features and embodiments that do not include all of the described features. Accordingly, the scope of the present invention is intended to embrace all such alternatives, modifications, and variations as fall within the scope of the claims, together with all equivalents thereof.

What is claimed is:

1. A reclining chair comprising:

a base;

a chair back adapted to recline from an upright position to a reclined position; and a flexible back support member coupling the chair back to the base, the flexible back support member including a flex zone located near a side of the reclining chair and formed from a resilient material, the flex zone of the flexible back support member comprising:

a first portion having a first notch extending through the first portion, the first notch adapted to narrow as the chair back reclines from the upright position to the reclined position, wherein the first notch is open when the chair back is in the upright position and at least partially closed when the chair back is in the reclined position, and a second portion that is laterally separated from the first portion by a gap, the second portion having a second notch extending through the second portion, the second notch adapted to narrow as the chair back reclines from the upright position to the reclined position, wherein the second notch is open in the upright position and at least partially closed in the reclined position.

2. The reclining chair of claim 1, wherein the flexible back support member is a first flexible back support member, the side of the reclining chair is a first side, and the flex zone is a first flex zone, the reclining chair further comprising:

a second flexible back support member coupling the chair back to the base, the second flexible back support member including a second flex zone located near a second side of the reclining chair and formed from a resilient material, the second flex zone of the second flexible back support member including:

a first portion that has a first notch extending through the first portion, the first notch being configured to narrow as the chair back reclines from the upright position to the reclined position, wherein the first notch is open when the chair back is in the upright position and at least partially closed when the chair back is in the reclined position, and a second portion that is separated laterally from the first portion by a gap, the second portion having a second notch extending through the second portion, the second notch being configured to narrow as the chair back reclines from the upright position to the reclined position, wherein the second notch is open in the upright position and at least partially closed in the reclined position.

3. The reclining chair of claim 2, wherein the first flex zone and the second flex zone form a lower flex region and wherein the chair back includes an upper flex zone formed of a resilient material.

4. The reclining chair of claim 1, wherein the flex zone has an upper portion and wherein the flex zone further comprises a plurality of ridges extending from the upper portion of the flex zone into the gap between the first and second portions.

5. The reclining chair of claim 1, wherein the flex zone is adapted to provide substantially all of the resistance to reclining motion of the chair back.

6. The reclining chair of claim 1, wherein the flex zone is adapted to define a range of effective pivot points.

7. The reclining chair of claim 1, wherein the chair back and the flex zone are integrally formed as a single unit.

8. A reclining chair comprising:

a base;

a seat support coupled to a seat, the seat support comprising:

a seat flex region unitarily formed of a resilient material, wherein the seat flex region is configured to flex as the seat moves from a first position, characterized by the seat defining a first tilt angle, to a second position, characterized by the seat defining a second tilt angle, and to provide increasing resistance as the seat moves from the first position to the second position; and a chair back, the chair back comprising a flexible back support member, wherein the flexible back support member includes:

an inner portion that has a first notch extending through the inner portion, wherein the first notch is configured to at least partially close as the chair back reclines from an upright position to a reclined position, an outer portion that is laterally separated from the inner portion by a gap, the outer portion having a second notch extending through the outer portion, wherein the second notch is configured to at least partially close as the chair back reclines from the upright position to the reclined position; and a connecting portion that couples the inner portion to the outer portion.

9. The reclining chair of claim 8, wherein the flexible back support member and the chair back are integrally formed and wherein the seat flex region and the seat support are integrally formed.

10. The reclining chair of claim 8, wherein the seat support includes a plurality of seat flex regions configured to flex as the seat moves from the first position to the second position and to provide increasing resistance as the seat moves from the first position to the second position.

11. The reclining chair of claim 8, wherein the seat support is unitarily formed with the seat.

12. The reclining chair of claim 8, wherein the flexible back support member further comprises a plurality of longitudinally extending ridges protruding from the connecting portion of the flexible back support member into the gap between the inner and outer portions of the flexible back support member.

13. A chair system comprising:

a seat support incorporating a resilient material, the seat support coupled to a seat;

a chair back including a lower flex region and an upper flex region, wherein the lower flex region includes at least a first flex zone and a second flex zone that are located beneath opposite sides of the seat, wherein the first flex zone and the second flex zone each include portions transversely separated by a gap, and wherein the upper flex region is location on the chair back at a location corresponding to a user's lumbar region; and a base.

14. The chair system of claim 13, wherein the first flex zone and the second flex zone each formed of the resilient material.

15. The chair system of claim 13, wherein the first flex zone has a plurality of notches that are each adapted to narrow as the chair back moves from an upright position to a reclined position and to create a series of reclining stops.

16. The chair system of claim 15, wherein a transverse cross-section of the first flex zone is characterized by an area moment of inertia that is smaller when the chair back is in the upright position than when the chair back in the reclined position.

17. The chair system of claim 16, wherein the transverse cross-section of the first flex zone corresponds to a location of one of the plurality of notches.

18. The chair system of claim 13, wherein each of the plurality of notches has a substantially uniform width when the chair back is in the upright position.

19. The chair system of claim 13, wherein the first flex zone and the second flex zone are each formed of a material having a substantially homogeneous and isotropic modulus of elasticity.

20. The chair system of claim 13, wherein the seat support is coupled to the base and wherein the first flex zone and the second flex zone are coupled to the base.

* * * * *

UNITED STATES PATENT AND TRADEMARK OFFICE

CERTIFICATE OF CORRECTION

PATENT NO. : 8,820,835 B2
APPLICATION NO. : 13/597966
DATED : September 2, 2014
INVENTOR(S) : Phillip David Minino et al.

It is certified that error appears in the above-identified patent and that said Letters Patent is hereby corrected as shown below:

In the Claims

Column 7, Line 41, Claim 1,
Remove "," and replace it with -- ; --

Column 7, Line 42, Claim 1,
Remove "that is"

Column 7, Line 59, Claim 2,
Remove "that has" and replace it with -- having --

Column 7, Line 64, Claim 2,
Remove "," and replace it with -- ; --

Column 7, Line 65, Claim 2,
Remove "that is"

Column 8, Line 34, Claim 8,
Remove "that has" and replace it with -- having --

Column 8, Line 37, Claim 8,
Remove "," and replace it with -- ; --

Column 8, Line 38, Claim 8,
Remove "that is"

Column 9, Line 8, Claim 14,
Following the word "zone", add the word -- are --

Column 9, Line 21, Claim 18,
Remove "13" and replace it with -- 15 --

Signed and Sealed this
Thirtieth Day of June, 2015

Michelle K. Lee

Michelle K. Lee
*Director of the United States Patent and Trademark Office*